US006226808B1

(12) United States Patent
Walshe

(10) Patent No.: US 6,226,808 B1
(45) Date of Patent: May 8, 2001

(54) BATHTUB AND SHOWER COMBINATION

(76) Inventor: Donal Walshe, 27 Chaplin Crescent, Sunbury-on-Thames, Middlesex TW16 7JB (GB)

( * ) Notice: Subject to any disclaimer, the term of this patent is extended or adjusted under 35 U.S.C. 154(b) by 0 days.

(21) Appl. No.: 09/595,466

(22) Filed: Jun. 16, 2000

(51) Int. Cl.[7] ..... A47K 4/00
(52) U.S. Cl. ..... 4/552; 4/556; 4/557; 4/612
(58) Field of Search ..... 4/548, 549, 552, 4/555–557, 596, 605, 607, 610, 612–614

(56) References Cited

U.S. PATENT DOCUMENTS

| | | | | |
|---|---|---|---|---|
| D. 319,093 | | 8/1991 | Dannenberg et al. . | |
| D. 360,022 | | 7/1995 | Smith . | |
| D. 369,399 | | 4/1996 | Dworetzky . | |
| D. 372,520 | | 8/1996 | Jacuzzi et al. . | |
| 1,604,810 | * | 10/1926 | Crist . | |
| 1,664,491 | * | 4/1928 | Siegel . | |
| 2,569,825 | * | 10/1951 | Otis . | |
| 3,719,960 | * | 3/1973 | Russell . | |
| 3,955,219 | * | 5/1976 | Finch et al. . | |
| 4,153,954 | | 5/1979 | Jacuzzi et al. . | |
| 5,001,787 | * | 3/1991 | Lynch | 4/552 |
| 5,642,959 | * | 7/1997 | Greferath | 4/596 |

* cited by examiner

*Primary Examiner*—Charles R. Eloshway

(57) ABSTRACT

A bathtub and shower combination for allowing an open bath area while preventing water from escaping the bathtub area while showering. The bathtub and shower combination includes a bathing stall. The bathing stall has a first and second walls joined at a vertical edge. The first and second walls are orientated generally perpendicular to each other. A bathtub is elongate and has a pair of end walls, a pair of side walls and a bottom wall. A first of end walls is fixedly coupled to the first wall of the bathing stall. A first of the side walls is fixedly coupled to the second wall of the bathing stall. Each of the walls of the bathtub has a top edge. A faucet for delivering water to the bathtub is mounted on a top edge of the bathtub. A shower portion includes a door. The door is hingedly coupled to a free vertical edge of the first wall of the bathing stall. A generally planar post extending vertically from the top edge of the second side wall. The post and the free vertical edge of the first wall defines a door frame for the door. A shower head delivers water to the shower portion. The shower head is fixedly mounted to the first wall of the bathing stall.

5 Claims, 2 Drawing Sheets

BATHTUB AND SHOWER COMBINATION

BACKGROUND OF THE INVENTION

1. Field of the Invention

The present invention relates to bathing stalls and more particularly pertains to a new bathtub and shower combination for allowing an open bath area while preventing water from escaping the bathtub area while showering.

2. Description of the Prior Art

The use of bathing stalls is known in the prior art. More specifically, bathing stalls heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,001,787; U.S. Des. Pat. No. 369,399; U.S. Des. Pat. No. 319,093; U.S. Pat. No. 4,153,954, U.S. Des. Pat. No. 360,022; and U.S. Des. Pat. No. 372,520.

While these devices fulfill their respective, particular objectives and requirements, the aforementioned patents do not disclose a new bathtub and shower combination. The inventive device includes a bathing stall. The bathing stall has a first and second walls joined at a vertical edge. The first and second walls are orientated generally perpendicular to each other. A bathtub is elongate and has a pair of end walls, a pair of side walls and a bottom wall. A first of end walls is fixedly coupled to the first wall of the bathing stall. A first of the side walls is fixedly coupled to the second wall of the bathing stall. Each of the walls of the bathtub has a top edge. A faucet for delivering water to the bathtub is mounted on a top edge of the bathtub. A shower portion includes a door. The door is hingedly coupled to a free vertical edge of the first wall of the bathing stall. A generally planar post extending vertically from the top edge of the second side wall. The post and the free vertical edge of the first wall defines a door frame for the door. A shower head delivers water to the shower portion. The shower head is fixedly mounted to the first wall of the bathing stall.

In these respects, the bathtub and shower combination according to the present invention substantially departs from the conventional concepts and designs of the prior art, and in so doing provides an apparatus primarily developed for the purpose of allowing an open bath area while preventing water from escaping the bathtub area while showering.

SUMMARY OF THE INVENTION

In view of the foregoing disadvantages inherent in the known types of bathing stalls now present in the prior art, the present invention provides a new bathtub and shower combination construction wherein the same can be utilized for allowing an open bath area while preventing water from escaping the bathtub area while showering.

The general purpose of the present invention, which will be described subsequently in greater detail, is to provide a new bathtub and shower combination apparatus and method which has many of the advantages of the bathing stalls mentioned heretofore and many novel features that result in a new bathtub and shower combination which is not anticipated, rendered obvious, suggested, or even implied by any of the prior art bathing stalls, either alone or in any combination thereof.

To attain this, the present invention generally comprises a bathing stall. The bathing stall has a first and second walls joined at a vertical edge. The first and second walls are orientated generally perpendicular to each other. A bathtub is elongate and has a pair of end walls, a pair of side walls and a bottom wall. A first of end walls is fixedly coupled to the first wall of the bathing stall. A first of the side walls is fixedly coupled to the second wall of the bathing stall. Each of the walls of the bathtub has a top edge. A faucet for delivering water to the bathtub is mounted on a top edge of the bathtub. A shower portion includes a door. The door is hingedly coupled to a free vertical edge of the first wall of the bathing stall. A generally planar post extending vertically from the top edge of the second side wall. The post and the free vertical edge of the first wall defines a door frame for the door. A shower head delivers water to the shower portion. The shower head is fixedly mounted to the first wall of the bathing stall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathtub and shower combination apparatus and method which has many of the advantages of the bathing stalls mentioned heretofore and many novel features that result in a new bathtub and shower combination which is not anticipated, rendered obvious, suggested, or even implied by any of the prior art bathing stalls, either alone or in any combination thereof.

It is another object of the present invention to provide a new bathtub and shower combination which may be easily and efficiently manufactured and marketed.

It is a further object of the present invention to provide a new bathtub and shower combination which is of a durable and reliable construction.

An even further object of the present invention is to provide a new bathtub and shower combination which is susceptible of a low cost of manufacture with regard to both materials and labor, and which accordingly is then susceptible of low prices of sale to the consuming public, thereby making such bathtub and shower combination economically available to the buying public.

Still yet another object of the present invention is to provide a new bathtub and shower combination which provides in the apparatuses and methods of the prior art some of the advantages thereof, while simultaneously overcoming some of the disadvantages normally associated therewith.

Still another object of the present invention is to provide a new bathtub and shower combination for allowing an open bath area while preventing water from escaping the bathtub area while showering.

Yet another object of the present invention is to provide a new bathtub and shower combination which includes a bathing stall. The bathing stall has a first and second walls joined at a vertical edge. The first and second walls are orientated generally perpendicular to each other. A bathtub is elongate and has a pair of end walls, a pair of side walls and a bottom wall. A first of end walls is fixedly coupled to the first wall of the bathing stall. A first of the side walls is fixedly coupled to the second wall of the bathing stall. Each of the walls of the bathtub has a top edge. A faucet for delivering water to the bathtub is mounted on a top edge of the bathtub. A shower portion includes a door. The door is hingedly coupled to a free vertical edge of the first wall of the bathing stall. A generally planar post extending vertically from the top edge of the second side wall. The post and the free vertical edge of the first wall defines a door frame for the door. A shower head delivers water to the shower portion. The shower head is fixedly mounted to the first wall of the bathing stall.

Still yet another object of the present invention is to provide a new bathtub and shower combination that has a bathtub having a side wall having an opening therein for easy access to the bathtub.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
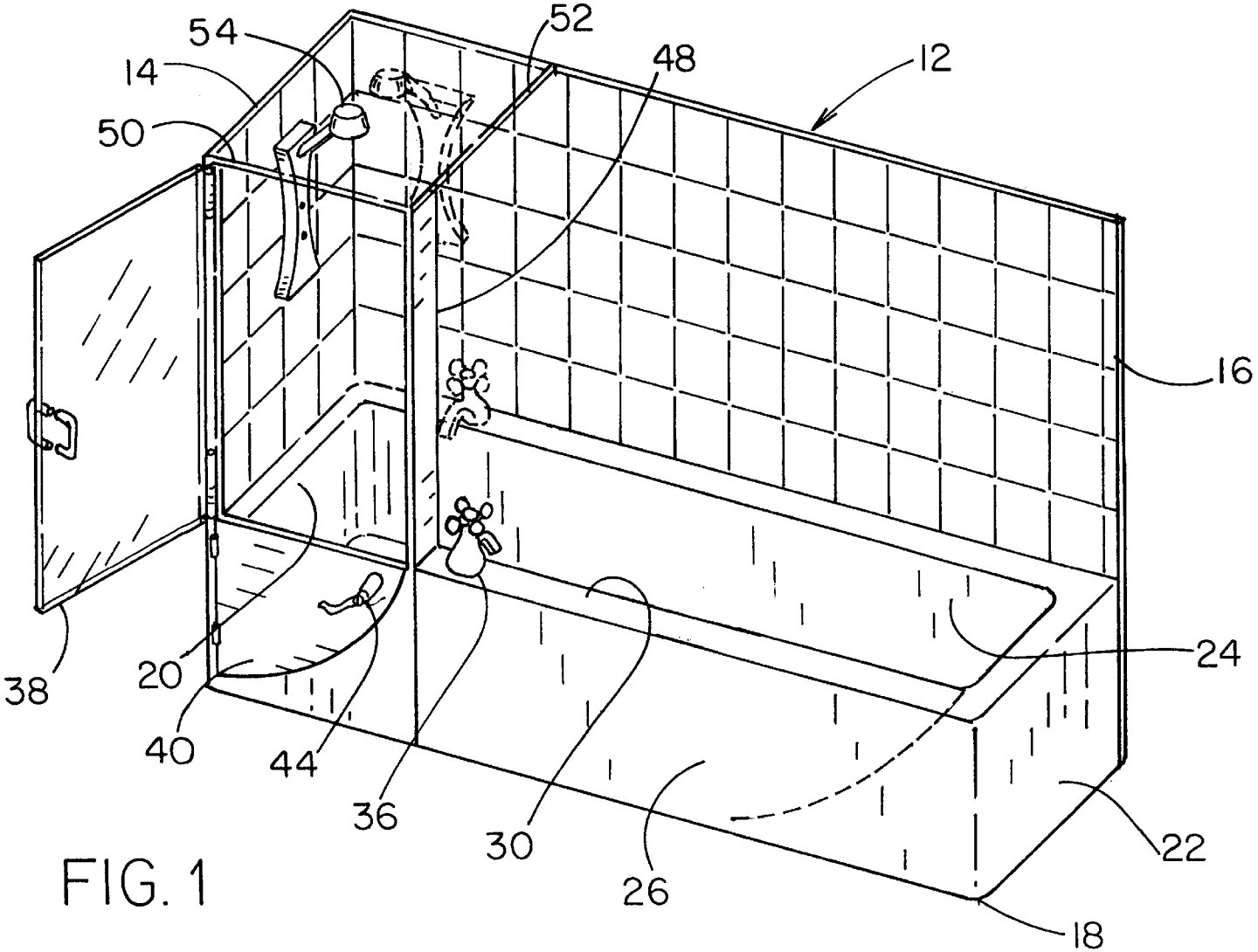
FIG. 1 is a schematic perspective view of a new bathtub and shower combination according to the present invention.
Figure 2:
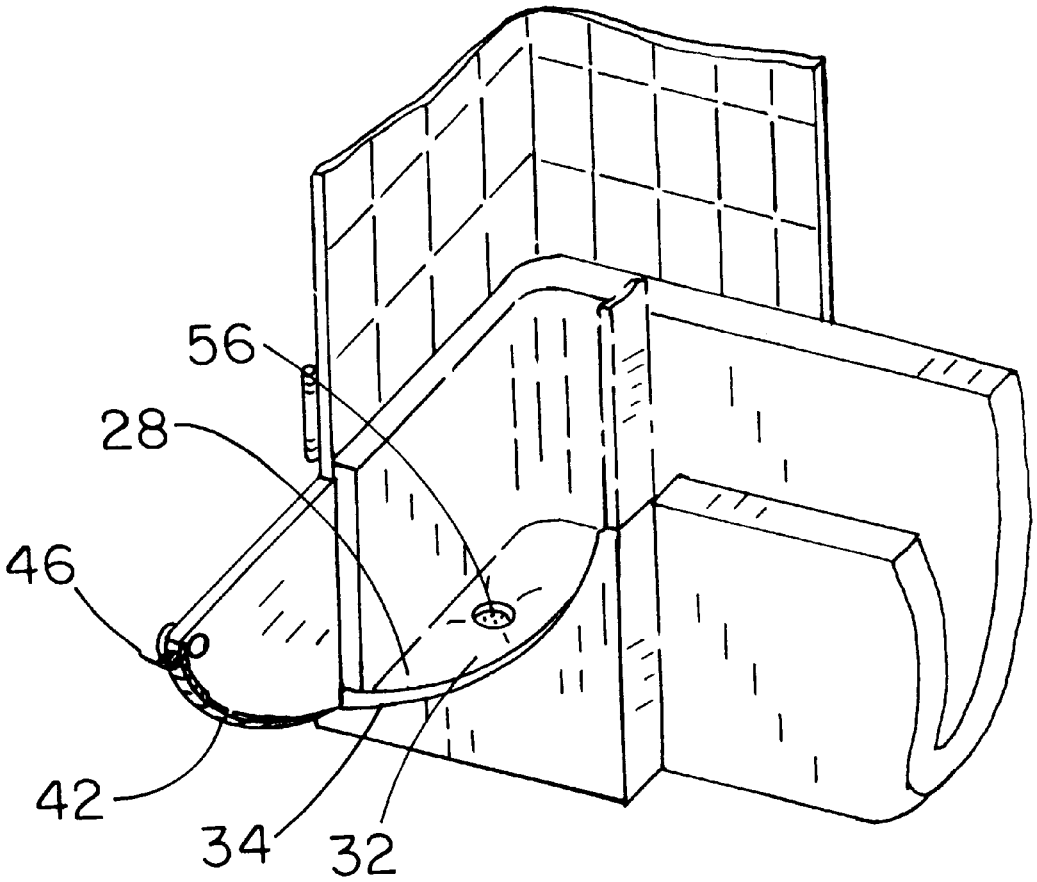
FIG. 2 is a schematic perspective view of the present invention.

With reference now to the drawings, and in particular to FIGS. 1 and 2 thereof, a new bathtub and shower combination embodying the principles and concepts of the present invention and generally designated by the reference numeral 10 will be described.

As best illustrated in FIGS. 1 and 2, the bathtub and shower combination 10 generally comprises a bathing stall. The bathing stall 12 has a first 14 and second walls 16 joined at a vertical edge. The first 14 and second 16 walls are orientated generally perpendicular to each other.

A bathtub 18 is elongate and a pair of end walls 20, 22, a pair of side walls 24, 26 and a bottom wall 28, and is generally a conventional bathtub. A first of end walls 20 is fixedly coupled to the first wall 14 of the bathing stall 12. A first of the side walls 24 is fixedly coupled to the second wall 16 of the bathing stall 12. Each of the walls of the bathtub 18 has a top edge 30. A second 26 of the side walls has an opening 32 therein. The opening 32 is generally adjacent to the first end wall 20. The opening 32 extends downwardly from the top edge 30 of the second side wall 26. The opening 32 has a generally arced edge 34 such that the opening 32 generally has a pie-shape. The bottom wall 28 is sloped toward the first end wall 20. A faucet 36 for delivering water to the bathtub 18 is mounted on a top edge 30 of the second side wall 26 and is positioned generally adjacent to the opening 32. The portion of the bathtub 18 having the opening therein may be extended away from the second wall as is shown in FIG. 2 to make more room in the shower portion of the device.

The shower portion comprises a door. The door is preferably dutch door such that the door has a top portion 38 and a bottom portion 40. The bottom portion 40 has a height substantially identical to a height of the tub 18. The bottom portion 40 is hingedly coupled to an edge of the first end wall 20 such that the bottom portion 40 may selectively open and close the opening 32 in the bathtub 18. The bottom portion 40 has a shape substantially identical to the opening 32. The bottom portion 40 has an outside edge 42 having a seal thereon adapted for preventing water from escaping the tub 18 when the bottom portion is closed. The seal is preferably an elastomeric material fixedly coupled to the edge. The bottom portion 40 has a handle 44 thereon for selectively turning a latch 46 to be received by the second side wall 26 of the bathtub. The bottom portion 40 is adapted to be selectively locked in a closed position. The top portion 38 is hingedly coupled to a free vertical edge of the first wall of the bathing stall. A generally planar post 48 extends vertically from the top edge 30 of the second side wall 26. The post 48 and the free vertical edge of the first wall 14 define a door frame for the top portion 38 of the door. A first supporting rod 50 extends between and is integrally coupled to the first wall 14 and the post 48. A second supporting rod 52 extends between and is integrally coupled to the second wall 16 and the post 48. The rods 50, 52 are orientated generally perpendicular to each other.

A shower head 54 delivers water into the shower portion. The shower head 54 is fixedly mounted to the first wall 14 of the bathing stall 12. It may also be mounted to the second wall 16 and directed toward the door.

In use, the device is used as a conventional shower or bathtub. The bathtub 18 has a drain 56 therein which is fluidly coupled to the drainage system of a dwelling and the shower head 54 and faucet 36 are fluidly connected to a water source. The bottom portion 40 of the door may be opened for easier access to the bathtub 18 and the shower portion. The opening 32 is preferably arced to make a better seal for filling the bathtub 18 with water.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination bathtub-shower device, said device comprising:

a bathing stall, said bathing stall having a first and second walls joined at a vertical edge, said first and second walls being orientated generally perpendicular to each other;

a bathtub, said bathtub being elongate having a pair of end walls, a pair of side walls and a bottom wall, a first of said end walls abutting and being fixedly coupled to said first wall of said bathing stall, a first of said side walls being fixedly coupled to said second wall of said bathing stall, each of said side and end walls of said bathtub having a top edge, a faucet for delivering water to said bathtub being mounted on one of said top edges of said bathtub;

a shower portion, said shower portion comprising:

a door, said door being hingedly coupled to a free vertical edge of said first wall over a substantial portion of the length of said door; of said bathing stall, a generally planar post extending vertically from one of said top edges of a second of said second side walls, said post and said free vertical edge of said first wall defining a door frame for said door; and a shower head for delivering water, said shower head being fixedly mounted to said first wall of said bathing stall.

2. The combination bathtub-shower device as in claim 1, wherein said device further comprises:

said second said side wall of said bathtub having an opening therein, said opening being generally adjacent to said first end wall, said opening extending downwardly from said top edge of said second side wall;

said door being a dutch door such that said door has a top portion and a bottom portion, said top portion being hingedly coupled to said vertical edge of said first wall, said bottom portion having a height substantially identical to a height of said tub and adapted to selectively close said opening in said bathtub, said bottom portion being hingedly coupled to an edge of said first end wall such that said bottom portion may selectively open and close said opening in said bathtub, said bottom portion having a shape substantially identical to said opening, said bottom portion having an outside edge having a seal thereon adapted for preventing water from escaping said tub when said bottom portion is closed.

3. The combination bathtub-shower device as in claim 2, wherein said bottom portion of said door further comprises:

said bottom portion having a handle thereon, said bottom portion being adapted to being selectively locked in a closed position.

4. The combination bathtub-shower device as in claim 2, wherein said bathtub further comprises:

said opening in said bathtub having a generally arced edge such that said opening generally has a pie-shape.

5. A combination bathtub-shower device, said device comprising:

a bathing stall, said bathing stall having a first and second walls joined at a vertical edge, said first and second walls being orientated generally perpendicular to each other;

a bathtub, said bathtub being elongate having a pair of end walls, a pair of side walls and a bottom wall, a first of said end walls being fixedly coupled to said first wall of said bathing stall, a first of said side walls being fixedly coupled to said second wall of said bathing stall, each of said side and end walls of said bathtub having a top edge, a second of said side walls having an opening therein, said opening being generally adjacent to said first end wall, said opening extending downwardly from said top edge of said second side wall, said opening having a generally arced edge such that said opening generally has a pie-shape, said bottom wall being sloped toward said first end wall, a faucet for delivering water to said bathtub being mounted on a top edge of said second side wall, said faucet being positioned generally adjacent to said opening;

a shower portion, said shower portion comprising:

a door, said door being a dutch door such that said door has a top portion and a bottom portion, said bottom portion having a height substantially identical to a height of said tub, said bottom portion being hingedly coupled to an edge of said first end wall such that said bottom portion may selectively open and close said opening in said bathtub, said bottom portion having a shape substantially identical to said opening, said bottom portion having an outside edge having a seal thereon adapted for preventing water from escaping said tub when said bottom portion is closed, said bottom portion having a handle thereon, said bottom portion being adapted to being selectively locked in a closed position, said top portion being hingedly coupled to a free vertical edge of said first wall of said bathing stall, a generally planar post extending vertically from said top edge of said second side wall, said post and said free vertical edge of said first wall defining a door frame for said top portion of said door, a first supporting rod extending between and integrally coupled to said first wall and said post, a second supporting rod extending between and integrally coupled to said second wall and said post; and a shower head for delivering water, said shower head being fixedly mounted to said first wall of said bathing stall.

* * * * *